US006899657B2

(12) United States Patent
Chuang

(10) Patent No.: US 6,899,657 B2
(45) Date of Patent: May 31, 2005

(54) EXERCISER FOR STEPPING AND SWINGING EXERCISES

(76) Inventor: Jin Chen Chuang, P.O. Box 63-99, Taichung (TW), 406

( * ) Notice: Subject to any disclaimer, the term of this patent is extended or adjusted under 35 U.S.C. 154(b) by 246 days.

(21) Appl. No.: 10/298,661

(22) Filed: Nov. 19, 2002

(65) Prior Publication Data

US 2004/0097337 A1 May 20, 2004

(51) Int. Cl.[7] ..... A63B 22/00; A63B 22/14
(52) U.S. Cl. ..... 482/52; 482/147
(58) Field of Search ..... 482/51–53, 146, 482/147, 70, 79, 80

(56) References Cited

U.S. PATENT DOCUMENTS

| | | | | |
|---|---|---|---|---|
| 3,650,528 A | | 3/1972 | Natterer | 272/57 B |
| 4,390,180 A | | 6/1983 | Simjian | 272/126 |
| 5,078,389 A | | 1/1992 | Chen | 272/70 |
| 5,183,448 A | | 2/1993 | Wang | 482/52 |
| 5,407,408 A | | 4/1995 | Wilkinson | 482/54 |
| 5,433,690 A | | 7/1995 | Gilman | 482/146 |
| 5,453,065 A | | 9/1995 | Lien et al. | 482/52 |
| 5,599,262 A | * | 2/1997 | Shih | 482/147 |
| 5,632,711 A | * | 5/1997 | Hwang | 482/147 |
| 5,695,439 A | * | 12/1997 | Lin | 482/146 |
| 5,888,176 A | | 3/1999 | Kuo | 482/53 |
| 5,888,182 A | * | 3/1999 | Shih | 482/147 |
| 5,908,373 A | * | 6/1999 | Pitre | 482/57 |
| 5,924,961 A | | 7/1999 | Kuo et al. | 482/52 |

* cited by examiner

*Primary Examiner*—Stephen R. Crow
(74) *Attorney, Agent, or Firm*—Charles E. Baxley

(57) ABSTRACT

An exerciser includes a handle and a support rotatably secured to a base, two foot pedals are rotatably secured to the support with spindles for allowing the users' feet to be rotated relative to the support and for preventing the users from being hurt or twisted while rotating relative to said base with the support. The support includes two blocks pivotally secured between two pivotal and parallel beams for supporting the foot pedals. A device may couple the the handle to the support for allowing the handle to be rotatably coupled to the support.

15 Claims, 6 Drawing Sheets

EXERCISER FOR STEPPING AND SWINGING EXERCISES

BACKGROUND OF THE INVENTION

1. Field of the Invention

The present invention relates to an exerciser, and more particularly to an exerciser for selectively conducting stepping and swinging operations or exercises.

2. Description of the Prior Art

Various kinds of typical exercisers have been developed for conducting various operations or exercises. For example, U.S. Pat. No. 3,650,528 to Natterer discloses an exerciser for conducting swinging or skiing operations. The users' feet may not be rotated relative to the support thereof. In addition, the exerciser may not be used for conducting the stepping operations.

U.S. Pat. No. 5,183,448 to Wang may be used for conducting stepping operations only. In addition, the foot pedals may not be rotated relative to the support thereof.

U.S. Pat. No. 4,390,180 to Simjian, U.S. Pat. No. 5,407,408 to Wilkinson, U.S. Pat. No. 5,433,690 to Gilman disclose three other exercisers which may be used for conducting rotating or swinging operations only. In addition, a single circular plate is provided for supporting the feet of the users, and includes a tiny space or area such that the feet of the users may not be suitably separated or opened from each other.

U.S. Pat. No. 5,078,389 to Chen discloses another exerciser which may be used for conducting rotating and swinging and stepping operations. However, similarly, a single tiny circular plate is provided for supporting the feet of the users, such that the feet of the users may not be suitably separated or opened from each other.

U.S. Pat. No. 5,888,176 to Kuo, and U.S. Pat. No. 5,924,961 to Kuo et al. disclose two further typical exercisers which may be used for conducting stepping operation, and which includes a rotatable handle for allowing the users to twist their upper portions. However, the feet of the users may not be rotated or twisted relative to the handle, such that the rotational movement of the users is limited.

U.S. Pat. No. 5,453,065 to Lien et al. discloses a still further typical exerciser including a stepper mechanism rotatably supported on a support frame, a base body rotatably attached to the support frame, and having a pair of spaced pedal arms that have one end rotatably secured to an upright front portion, such that the exerciser includes a complicated configuration and a great cost.

The present invention has arisen to mitigate and/or obviate the afore-described disadvantages of the conventional exercisers.

SUMMARY OF THE INVENTION

The primary objective of the present invention is to provide an exerciser may be provided for selectively conducting stepping and swinging operations or exercises.

The other objective of the present invention is to provide an exerciser including a pair of foot pedals rotatably and separately supported on a support for separately supporting the feet of the users, and for preventing the users from being hurt or twisted while conducting the swinging operations or exercises.

In accordance with one aspect of the invention, there is provided an exerciser comprising a base including a shaft provided thereon, a handle device secured to the base, for supporting upper portion of users, a support rotatably secured to the base with the shaft, two spindles rotatably attached to the support and separated from each other, and two foot pedals secured to the spindles and rotatably secured to the support with the spindles, for supporting users' feet. The foot pedals are rotatable relative to the support when the support is rotated relative to the base, for allowing the users' feet to be rotated relative to the support and for preventing the users from being hurt or twisted while rotating relative to said base with the support.

The support includes a seat rotatably secured to the base with the shaft, and a first beam having a middle portion rotatably secured to the seat and having two end portions for supporting the foot pedals respectively.

The support includes two blocks pivotally secured to the end portions of the first beam for supporting the foot pedals. The blocks each includes an orifice formed therein for rotatably receiving the spindles respectively.

The support further includes a second beam having a middle portion rotatably secured to the seat and having two end portions pivotally secured to the blocks respectively, the first beam and the second beam are parallel to each other to form a parallelogram together with the blocks. The support may include a spring biasing device for biasing the first arm relative to the seat.

The handle device includes a lower segment rotatably secured to the base with a pin, a shank rotatably secured to the lower segment with a pivot rod, and means for selectively securing the shank to the lower segment of the handle device.

A device may further be provided for coupling the the handle device to the support, and includes a first rotary member attached to the support, and a second rotary member attached to the handle device and coupled to the first rotary member.

The coupling means further includes a coupling member engaged over the first and the second rotary members for rotatably coupling the first and the second rotary members together.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
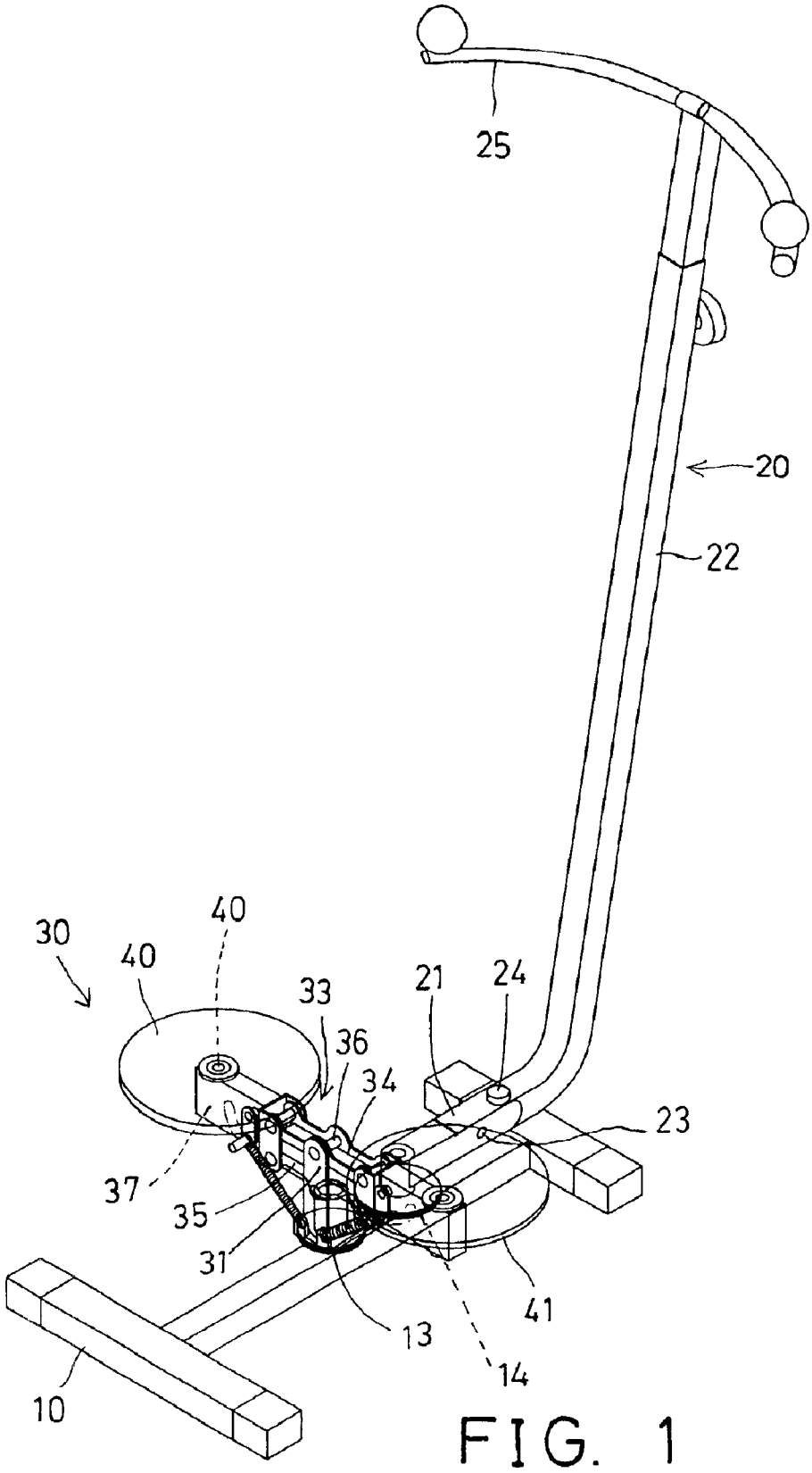
FIG. 1 is a perspective view of an exerciser in accordance with the present invention.
Figure 2:
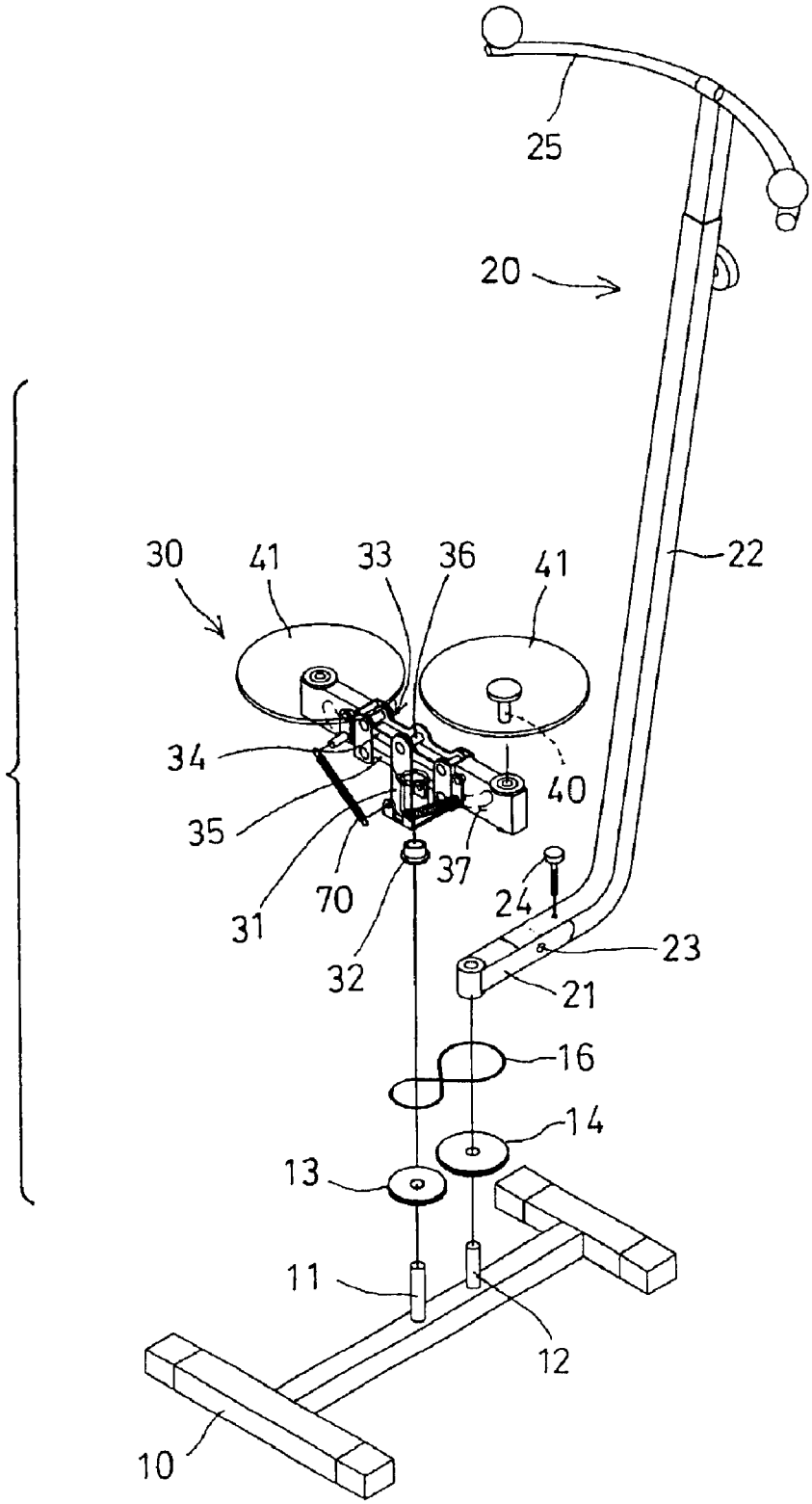
FIG. 2 is a partial exploded view of the exerciser.
Figure 3:
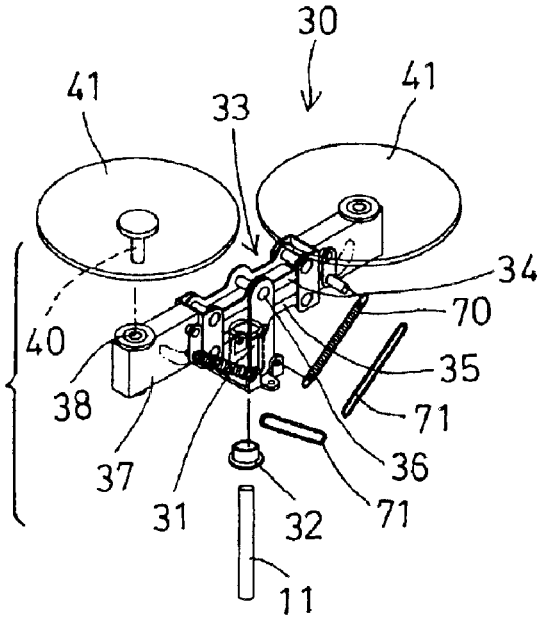
FIG. 3 is another partial exploded view illustrating the stepping device of the exerciser.

Referring to the drawings, and initially to FIGS. 1–4, an exerciser in accordance with the present invention comprises a base 10 including a shaft 11 and a pin 12 provided thereon, such as upwardly extended therefrom, two rotary members 13, 14 rotatably secured on the shaft 11 and the pin 12 respectively and coupled together with a coupling member 16, such as a belt or a cable 16 or the like.

Figure 9:
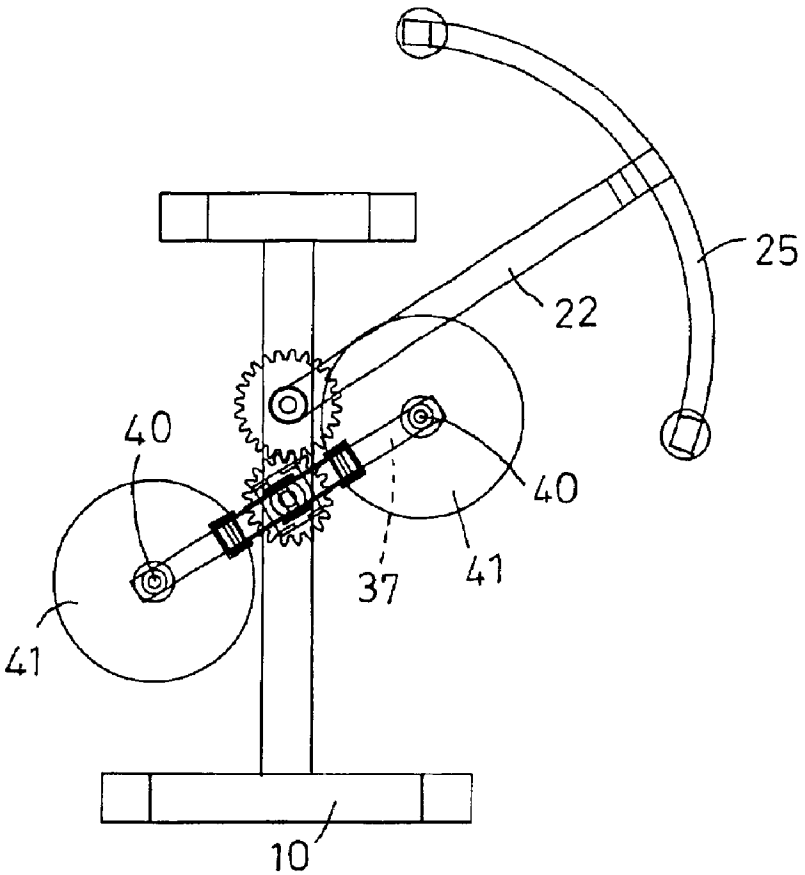
FIG. 9 is a top plan view illustrating the other arrangement of the exerciser.
Figure 8:
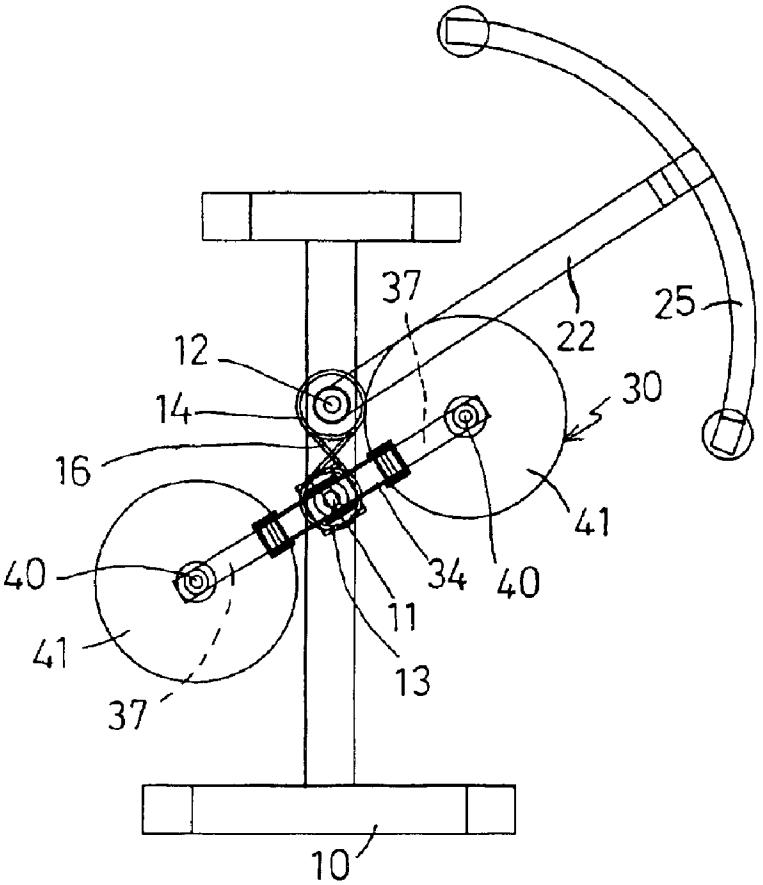
FIG. 8 is a top plan view similar to FIG. 7, illustrating the operation of the exerciser.

For example, the rotary members 13, 14 may be the disks or the pulleys 13, 14 and rotatably coupled together with a belt, a cable 16 or the like, for allowing the pulleys 13, 14 to be rotatably coupled together with the cable 16. Alternatively, the rotary members 13, 14 may be the gears as shown in FIG. 9 and directly engaged with each other.

A handle device 20 is provided for supporting the upper portion of the users, and includes a lower segment 21 rotatably or pivotally engaged onto the pin 12, and preferably secured to the rotary member 14, for allowing the handle device 20 to be rotated in concert with the rotary member 14, and includes a shank 22 having a hand grip 25 adjustably provided on top thereof.

For example, the shank 22 of the handle device 20 includes a lower portion rotatably secured to the lower segment 21 with a pivot rod 23, and releasably secured to the lower segment 21 with a fastener 24, which may secure the shank 22 at an upright or working position relative to the lower segment 21 as shown in FIG. 1.

A stepping device 30 includes a support 33 having a seat 31 rotatably or pivotally engaged onto the shaft 11, and preferably secured to the rotary member 13, for allowing the stepping device 30 to be rotated in concert with the rotary member 13, and for allowing the stepping device 30 to be rotatably coupled to the handle device 20 with the rotary members 13, 14 and the cable 16.

The support 33 of the stepping device 30 includes one or more, such as two beams 34, 35 parallel to each other and each having a middle portion rotatably or pivotally secured to the seat 31 with a pivot axle 36 respectively, and two blocks 37 secured to the ends of the beams 34, 35.

Figure 4:
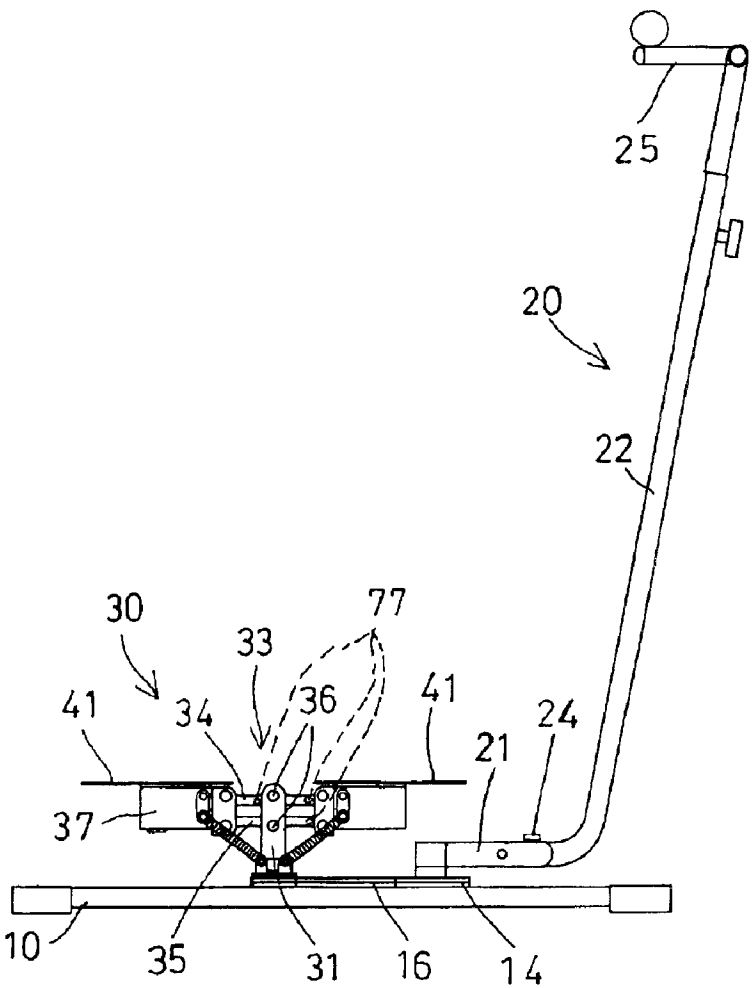
FIG. 4 is a side view of the exerciser.
Figure 5:
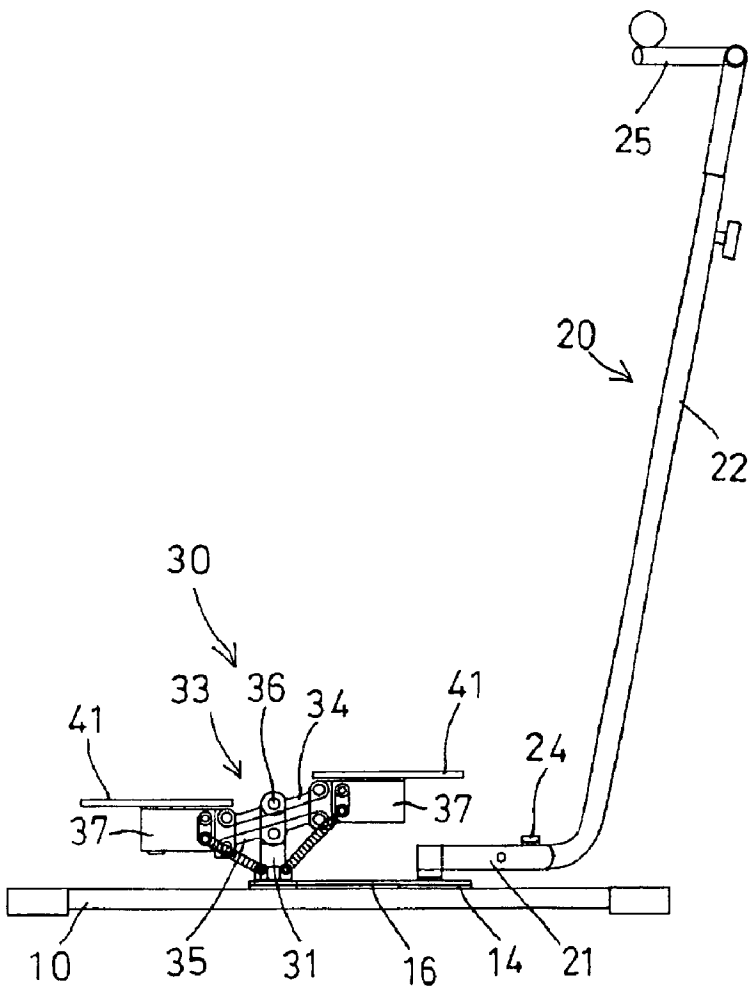
FIG. 5 is a side view similar to FIG. 4, illustrating the operation of the exerciser.
Figure 7:
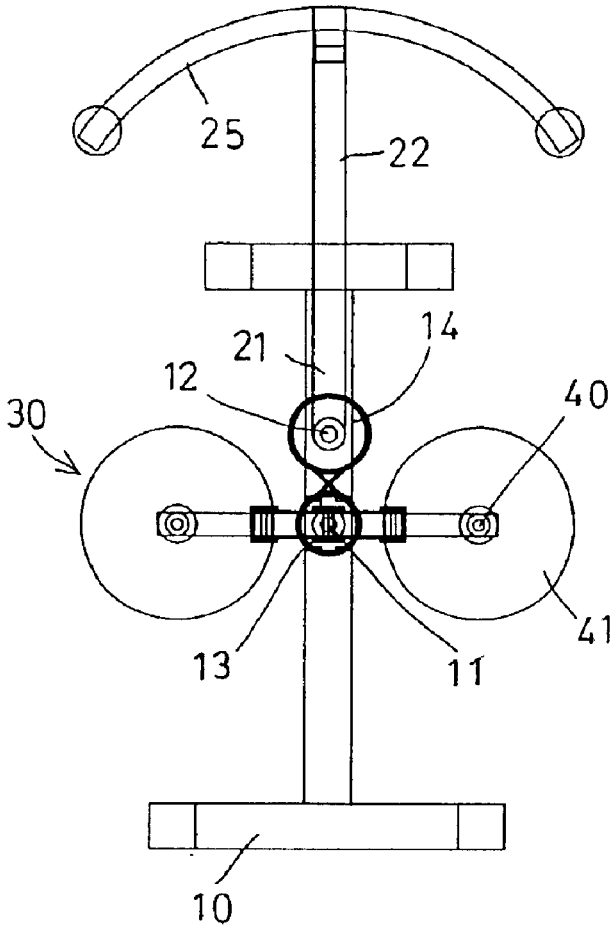
FIG. 7 is a top plan view of the exerciser.
Figure 6:
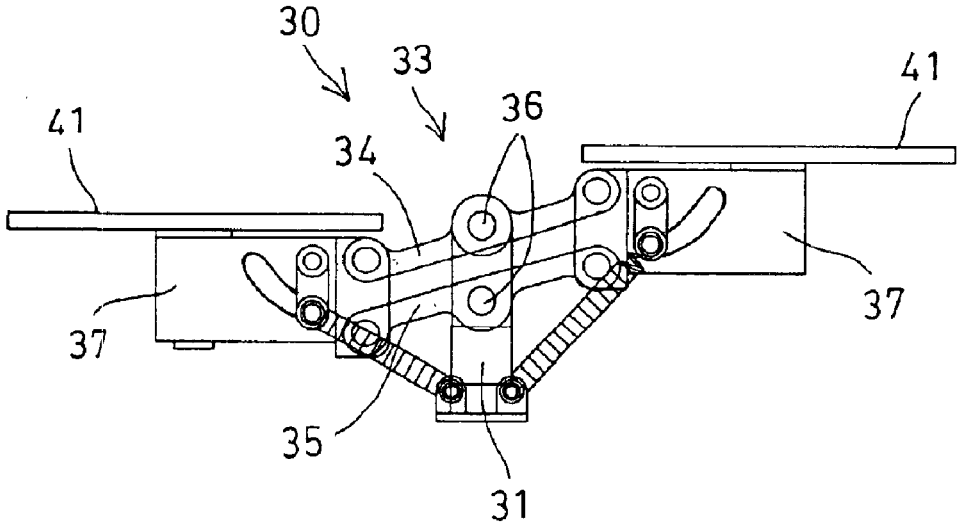
FIG. 6 is an enlarged partial side view illustrating the operation of the exerciser.

In operation, as shown in FIGS. 4–6, when the beams 34, 35 are rotated relative to the seat 31 about the pivot axles 36 respectively, the beams 34, 35 may be formed or maintained in a parallelogram structure, such that the blocks 37 may be maintained in the horizontal position relative to the base 10, and will not be tilted or inclined relative to the base 10 when the blocks 37 move up and down relative to the base 20.

The blocks 37 each includes an orifice 38 formed therein (FIG. 3), or the support 33 includes two orifices 38 separately formed therein, for rotatably receiving a spindle 40 therein that may be attached to a foot pedal 41 or the like. The foot pedals 41 may thus be rotatably secured on the beams 34, 35 or on the support 33 with the respective spindles 40, and are separated from each other, for separately supporting the feet of the users.

One or more spring biasing members 70, 71, such as the springs 70, or the resilient belts 71, or the pneumatic or hydraulic cylinders (not shown) may further be provided and coupled between the seat 31 and the beams 34, 35 or the support 33, for biasing or recovering the support 33, or for biasing the beams 34, 35 back to the rest position that parallel to the base 10, as shown in FIG. 4, or for providing the resistive force against the foot pedals 41.

In operation, one of the blocks 37 and the corresponding foot pedals 41 may be moved or stepped downward toward the base 10 by the users, and the other block 37 and foot pedal 41 will thus be moved upwardly or away from the base 10 due to the pivotal coupling of the beams 34, 35 to the seat 31, such that the users may conduct stepping operations or exercises with the foot pedals 41 of the stepping device 30.

The spring biasing members 70, 71 may bias or recover the support 33 or the beams 34, 35 back to the rest position that parallel to the base 10, as shown in FIG. 4, after the foot pedals 41 are released. Relatively, the users may have to spend energy to overcome the spring biasing force of the spring biasing members 70, 71.

In addition, the users may also rotate the stepping device 30 in order to rotate the handle device 20 and to swing or twist the users' waist portion. Relatively, the users may also rotate the handle device 20 relative to the base 10, in order to rotate the stepping device 30.

It is to be noted that the foot pedals 41 are rotatably secured or supported on the blocks 37 or separately supported on the ends of the beams 34, 35 or the support 33, for separately supporting the feet of the users, and for allowing the feet of the users to be comfortably supported on the foot pedals 41.

Particularly, when the blocks 37 and/or the beams 34, 35 of the support 33 are rotated relative to the base 10, the foot pedals 41 may also be rotated relative to the the blocks 37 and/or the beams 34, 35 of the support 33, and thus will not be twisted or hurt during the swinging or rotating operations.

When the users would like to conduct the stepping operation only, a longer fastener 24 may be engaged through the handle device 20 and the base 10, in order to secure the handle device 20 to the base 10, and for allowing the foot pedals 41 to be moved or stepped downwardly toward the base 10.

Alternatively, when no stepping exercises are to be operated, as shown in dotted lines in FIG. 4, one or more fasteners or latches 77 may further be provided to secure the beams 34, 35 to the seat 31, or to the blocks 37, for preventing the beams 34, 35 from being moved or stepped or rotated relative to the seat 31, and for allowing the users to rotate or swing or twist with the stepping device 30 and the handle 20.

Figure 10:
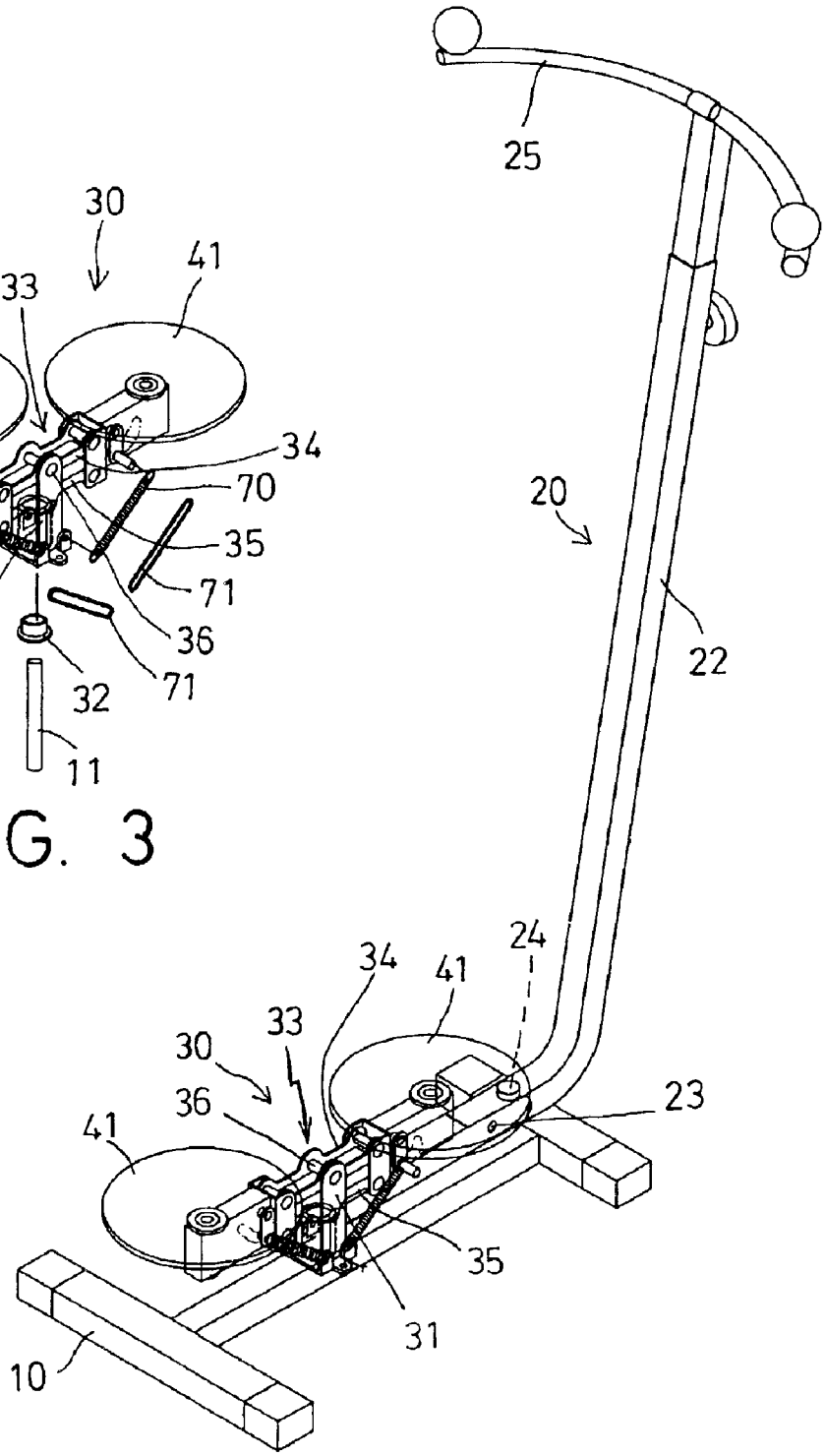
FIG. 10 is a perspective view illustrating the further arrangement of the exerciser.

Further alternatively, as shown in FIG. 10, the rotary members 13, 14 and the coupling member 16 may be removed from the base 10, and the stepping device 30 and the handle device 20 may be freely and rotatably secured onto the base 10 with the shaft 11 and the pin 12 respectively, for allowing the stepping device 30 and the handle device 20 to be randomly rotated relative to the base 10 with the shaft 11 and the pin 12 respectively.

The fastener 24 may also be used to selectively secure the handle device 20 to the base 10. The fasteners or latches 77 (FIG. 4) may also be selectively used to lock the stepping device 30, for preventing the stepping device 30 from being operated with the stepping operations. Another fastener (not shown) may further be provided for selectively securing such as the seat 31 of the stepping device 30 to the base 10, and for preventing the stepping device 30 from rotating relative to the base 10.

Accordingly, the exerciser in accordance with the present invention may be provided for selectively conducting stepping and swinging operations or exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a shaft provided thereon, a handle device secured to said base, for supporting upper portion of users, said handle device including a lower segment rotatably secured to said base with a pin, and including a shank rotatably secured to said lower segment with a pivot rod, and means for selectively securing said shank to said lower segment of said handle device, a support rotatably secured to said base with said shaft, two spindles rotatably attached to said support and separated from each other, and two foot pedals secured to said spindles and rotatably secured to said support with said spindles, for supporting users' feet, said foot pedals being rotatable relative to said support when said support is rotated relative to said base.

2. The exerciser according to claim 1, wherein said support includes a seat rotatably secured to said base with said shaft, and a first beam having a middle portion rotatably secured to said seat and having two end portions for supporting said foot pedals respectively.

3. An exerciser comprising:

a base including a shaft provided thereon, a handle device secured to said base, for supporting upper portion of users, a support rotatably secured to said base with said shaft, said support including a seat rotatably secured to said base with said shaft, and a first beam having a middle portion rotatably secured to said seat and having two end portions, two spindles rotatably attached to said support and separated from each other, and two foot pedals secured to said spindles and rotatably secured to said support with said spindles, for supporting users' feet, said end portions of said first beam of said support being provided for supporting said foot pedals respectively, and said support including two blocks pivotally secured to said end portions of said first beam for supporting said foot pedals, said foot pedals being rotatable relative to said support when said support is rotated relative to said base.

4. The exerciser according to claim 3, wherein said blocks each includes an orifice formed therein for rotatably receiving said spindles respectively.

5. The exerciser according to claim 3, wherein said support further includes a second beam having a middle portion rotatably secured to said seat and having two end portions pivotally secured to said blocks respectively, said first beam and said second beam are parallel to each other to form a parallelogram together with said blocks.

6. The exerciser according to claim 2, wherein said support includes means for biasing said first beam relative to said seat.

7. The exerciser according to claim 1 further comprising means for coupling said handle device to said support.

8. The exerciser according to claim 7, wherein said coupling means includes a first rotary member attached to said support, and a second rotary member attached to said handle device and coupled to said first rotary member.

9. The exerciser according to claim 8, wherein said coupling means further includes a coupling member engaged over said first and said second rotary members for rotatably coupling said first and said second rotary members together.

10. An exerciser comprising:

a base including a shaft and a pin provided thereon, a handle device secured to said base with said pin, for supporting upper portion of users, a support including a seat rotatably secured to said base with said shaft, and a first beam having a middle portion rotatably secured to said seat and having two end portions, and including means for biasing said first beam relative to said seat, two foot pedals supported on said end portions of said first beam respectively, for supporting users' feet, and means for rotatably coupling said support to said handle device.

11. An exerciser comprising:

a base including a shaft and a pin provided thereon, a handle device secured to said base with said pin, for supporting upper portion of users, a support including a seat rotatably secured to said base with said shaft, and a first beam having a middle portion rotatably secured to said seat and having two end portions, two foot pedals supported on said end portions of said first beam respectively, for supporting users' feet, and said support including two blocks pivotally secured to said end portions of said first beam for supporting said foot pedals, and means for rotatably coupling said support to said handle device.

12. The exerciser according to claim 11, wherein said blocks each includes an orifice formed therein, said foot pedals each includes a spindle rotatably received in said orifices of said blocks respectively.

13. The exerciser according to claim 11, wherein said support further includes a second beam having a middle portion rotatably secured to said seat and having two end portions pivotally secured to said blocks respectively, said first beam and said second beam are parallel to each other to form a parallelogram together with said blocks.

14. The exerciser according to claim 10, wherein said handle device includes a lower segment rotatably secured to said base with said pin, and a shank rotatably secured to said lower segment with a pivot rod, and means for selectively securing said shank to said lower segment of said handle device.

15. The exerciser according to claim 10, wherein said coupling means includes a first rotary member attached to said support, and a second rotary member attached to said handle device and coupled to said first rotary member.

* * * * *